US006062685A

United States Patent [19]

Ohyama et al.

[11] Patent Number: 6,062,685

[45] Date of Patent: May 16, 2000

[54] SHEET CONVEY APPARATUS

[75] Inventors: Kazuo Ohyama, Mitaka; Haruo Uchida, Yokohama, both of Japan

[73] Assignee: Canon Kabushiki Kaisha, Tokyo, Japan

[21] Appl. No.: 08/580,088

[22] Filed: Dec. 20, 1995

[30] Foreign Application Priority Data

Dec. 26, 1994 [JP] Japan ..... 6-322405

[51] Int. Cl.[7] ..... B41J 13/00

[52] U.S. Cl. ..... 347/104; 101/425; 400/701; 271/207

[58] Field of Search ..... 347/104; 101/425; 15/256.52, 256.5, 256.51; 400/641, 701; 271/207, 314, 252, 250

[56] References Cited

U.S. PATENT DOCUMENTS

| | | | |
|---|---|---|---|
| 5,163,674 | 11/1992 | Parks | 271/274 |
| 5,207,160 | 5/1993 | Harada | 101/425 |
| 5,719,611 | 2/1998 | Nakamura et al. | 347/103 |

FOREIGN PATENT DOCUMENTS

| | | |
|---|---|---|
| 0424968A3 | 5/1991 | European Pat. Off. . |
| 0580399A3 | 1/1994 | European Pat. Off. . |
| 0586175A1 | 3/1994 | European Pat. Off. . |
| 0619577A1 | 10/1994 | European Pat. Off. . |
| 0657880A2 | 6/1995 | European Pat. Off. . |
| 0668586A2 | 8/1995 | European Pat. Off. . |
| 1226379 | 9/1989 | Japan . |
| 6-182984 | 7/1994 | Japan . |

OTHER PUBLICATIONS

Patent Abstracts of Japan, vol. 18, No. 526, (M–1683), Oct. 5, 1994.

Patent Abstracts of Japan, vol. 13, No. 545 (M–902), Dec. 6, 1989.

*Primary Examiner*—John Barlow
*Assistant Examiner*—Christine Annick
*Attorney, Agent, or Firm*—Fitzpatrick, Cella, Harper & Scinto

[57] ABSTRACT

A recording medium convey apparatus including a rotary member rotated while contacting with a recorded surface of a recording medium on which the recording was effected by using ink, and a cleaner for removing the ink transferred to the rotary member from the recorded surface of the recording medium, and wherein a contact position where said rotary member and said cleaner means in an axial direction, and at least one of said rotary member and said cleaner means is fixed to be inclined with respect to a rotation device.

21 Claims, 7 Drawing Sheets

SHEET CONVEY APPARATUS

BACKGROUND OF THE INVENTION

1. Field of the Invention

The present invention relates to an ink jet recording apparatus for recording an image on a recording medium such as a paper sheet by discharging ink, and more particularly, it relates to a convey apparatus for conveying a recording medium after recording.

2. Related Background Art

In conventional ink jet recording apparatuses in which the recording is effected by discharging ink, for example, as disclosed in the Japanese Patent Application Laid-Open No. 1-226379 (1989), a convey apparatus for conveying a recording medium discharged from a recording portion includes spur-like rotary members (referred to as "spurs" hereinafter) associated with a discharge roller and adapted to discharge the recording medium from the recording portion, and absorb members (acting as means for removing ink transferred to the spurs from the recorded surface of the recording medium) slidingly contacted with peripheral surfaces (particularly, tips of teeth) of the rotating spurs, so that the ink transferred to the spurs are absorbed to prevent the ink from transferring onto the recording medium.

An example of such convey apparatus is shown in FIGS. 6 and 7.

Spurs 16 serve to urge a recording medium 6 against a discharge roller 15 (for discharging the recording medium 6 from a recording portion) disposed at a downstream side of a recording head in a recording medium conveying direction and driven by a motor (not shown) through a gear train. Spur cleaners 17 made of water-absorbing material are urged against peripheral surfaces of the corresponding spurs 16 and are rotated by the movement of the spurs 16. The spurs 16 are held by respective spur supports 18 and the spur cleaners 17 are held by respective spur cleaner supports 19. A spur shaft 20 for supporting the corresponding spur and a spur cleaner shaft 21 for supporting the corresponding spur cleaner are rotatably mounted on a corresponding spur guide 22.

On the other hand, the spur guides 22 are mounted on a spur guide shaft 23 extending in parallel with the discharge roller 15 so that the spurs can be rocked toward and away from the discharge roller 15. However, the spurs are urged against the discharge roller 15 by a biasing means (not shown).

As shown in FIG. 6, each spur 16 abuts against a central portion of the corresponding spur cleaner 17 in a widthwise direction thereof. With this arrangement, the recording medium frequently reaches the discharge roller 15 before the ink on the recorded surface of the recording medium is completely dried depending upon the discharge amount of ink in a recording mode of an ink jet recording apparatus, by removing the ink transferred to the spurs 16 from the recorded surface of the recording medium 6 by means of the spur cleaners 17. Thus, the ink can be prevented from transferring to the recorded surface form the spurs 16 again.

However, in the above-mentioned conventional example, since the spurs always abut against the same portions of the spur cleaners, the service life of the spur cleaners is shortened.

Further, as shown in FIG. 7, since the ink 26 removed from the spurs 16 are accumulated in the same portions of the spur cleaners 17, the absorbing efficiency of each spur cleaner per unit area is worsened, and, thus, the ink removing ability is reduced. Conversely, it is feared that the ink accumulated in the spur cleaners 17 is transferred to the spurs 16 to smudge the recorded surface of the recording medium 6.

SUMMARY OF THE INVENTION

An object of the present invention is to eliminate the above-mentioned conventional drawbacks.

To achieve the above object, according to the present invention, there is provided a recording medium convey apparatus comprising a rotary member rotated while contacting with a recorded surface of a recording medium on which the recording was effected by using ink, and a cleaner means for removing the ink transferred to the rotary member from the recorded surface of the recording medium. Wherein a contact position between the rotary member and the cleaner means can be shifted in a widthwise direction of the rotary member.

With this arrangement, since the contact position between the rotary member and the cleaner means can be shifted in the widthwise direction of the rotary member, the service life of the cleaner means is increased and the absorbing efficiency of the cleaner means per unit area is improved.

DETAILED DESCRIPTION OF THE PREFERRED EMBODIMENTS

First Embodiment

Figure 1:
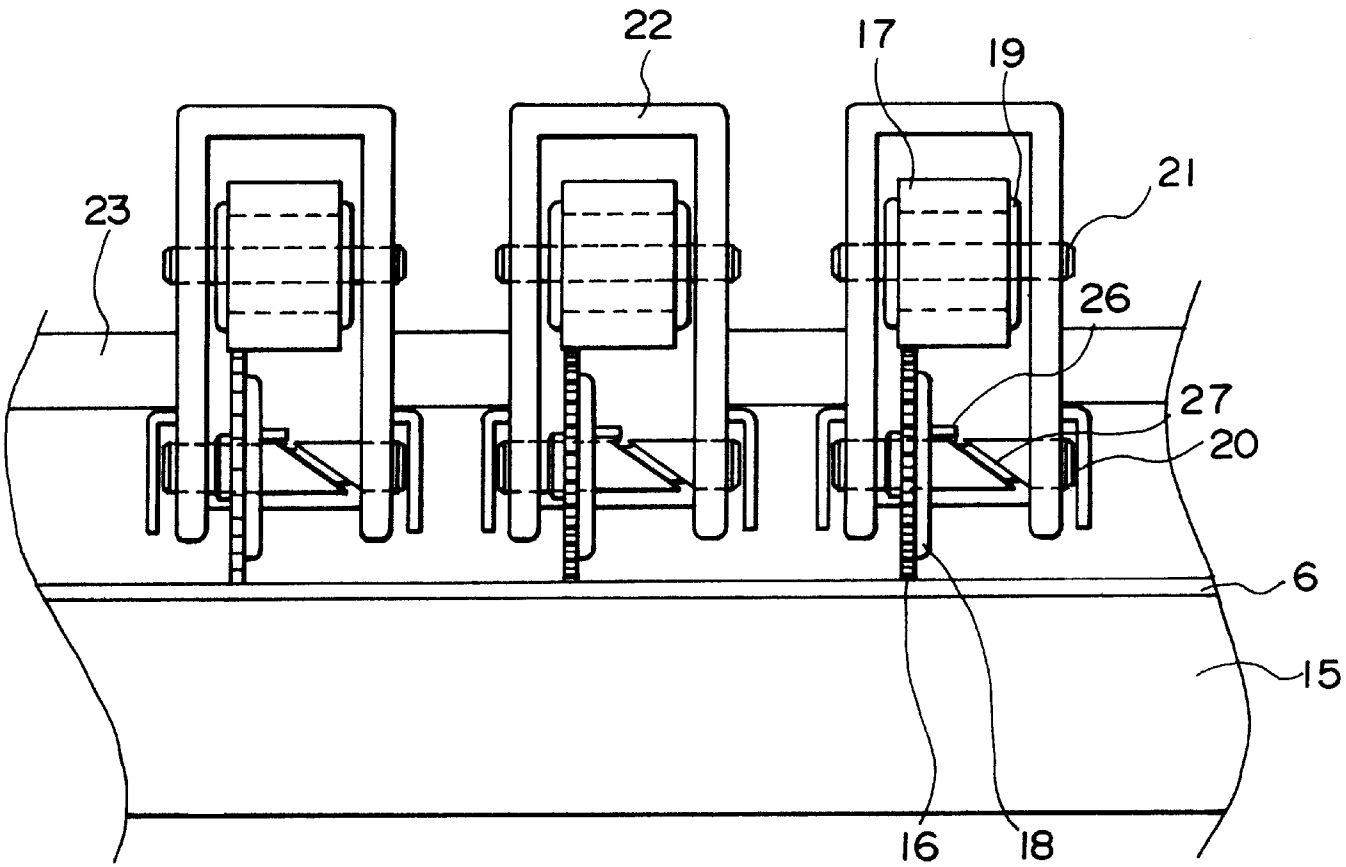
FIG. 1 is a front view of a discharge roller and therearound, according to a first embodiment of the present invention.
Figure 5:
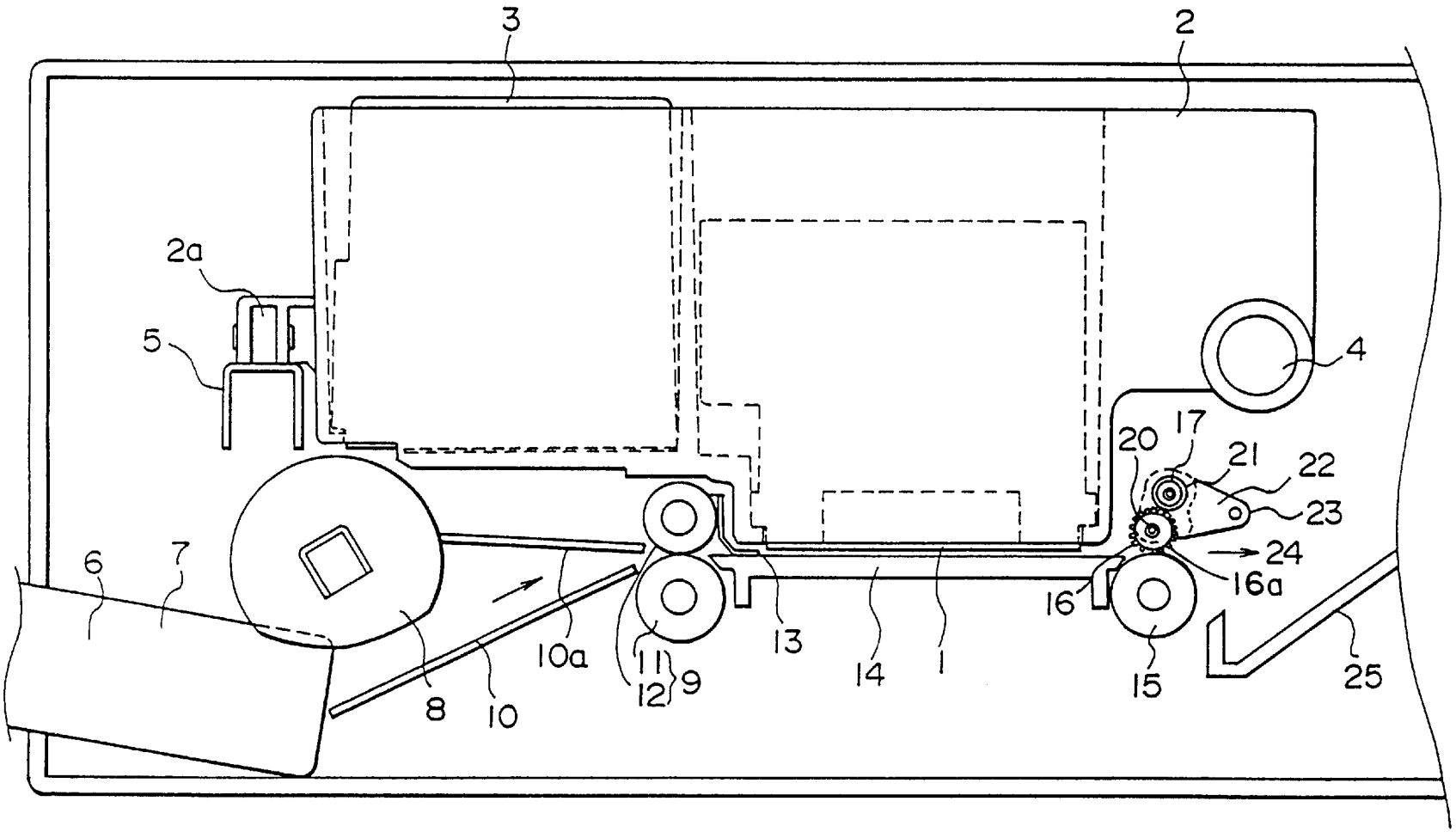
FIG. 5 is a schematic sectional view of a recording apparatus to which the present invention can be applied.
Figure 6:
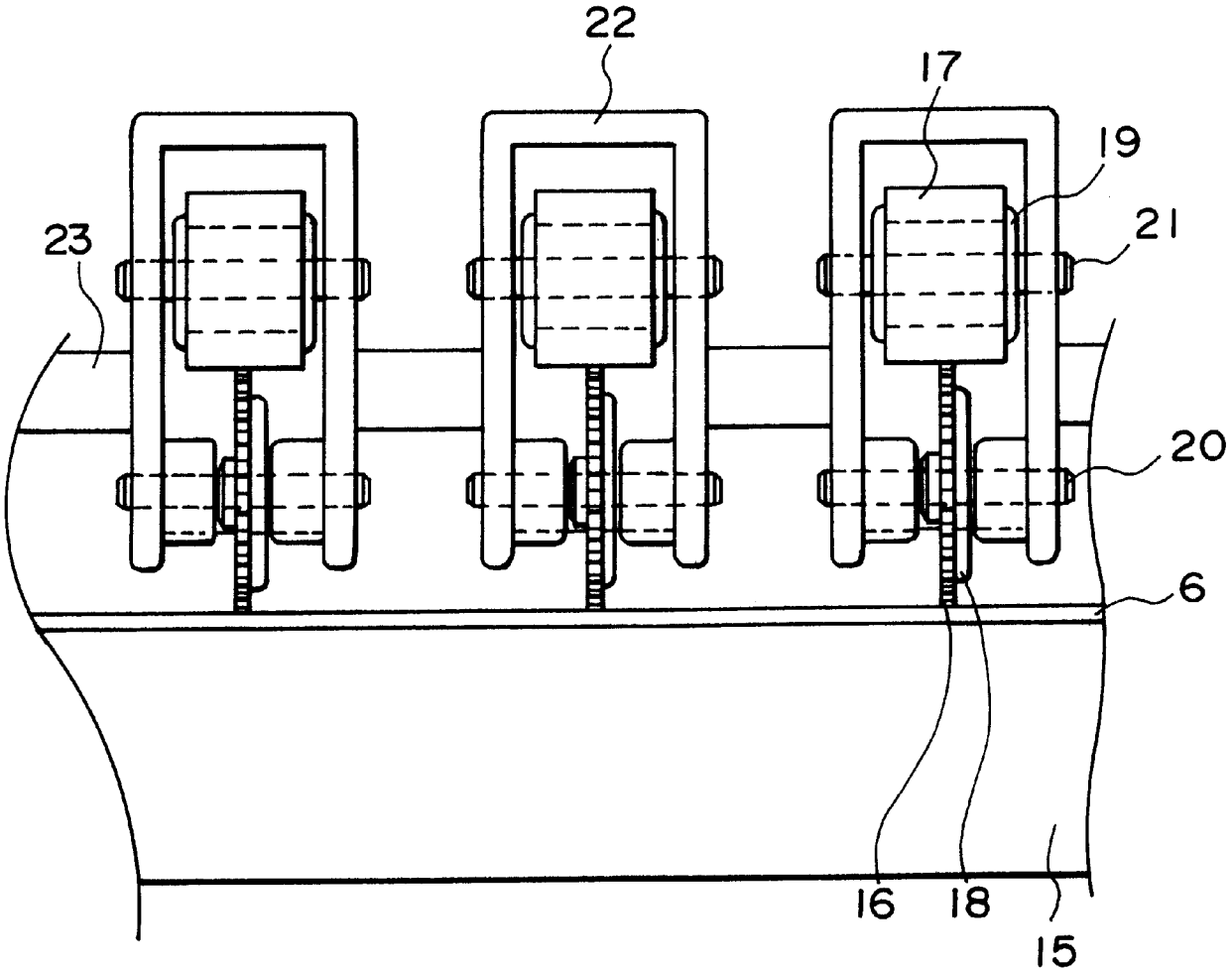
FIGS. 6 and 7 are front views of a discharge roller and therearound, in a conventional example.
Figure 7:
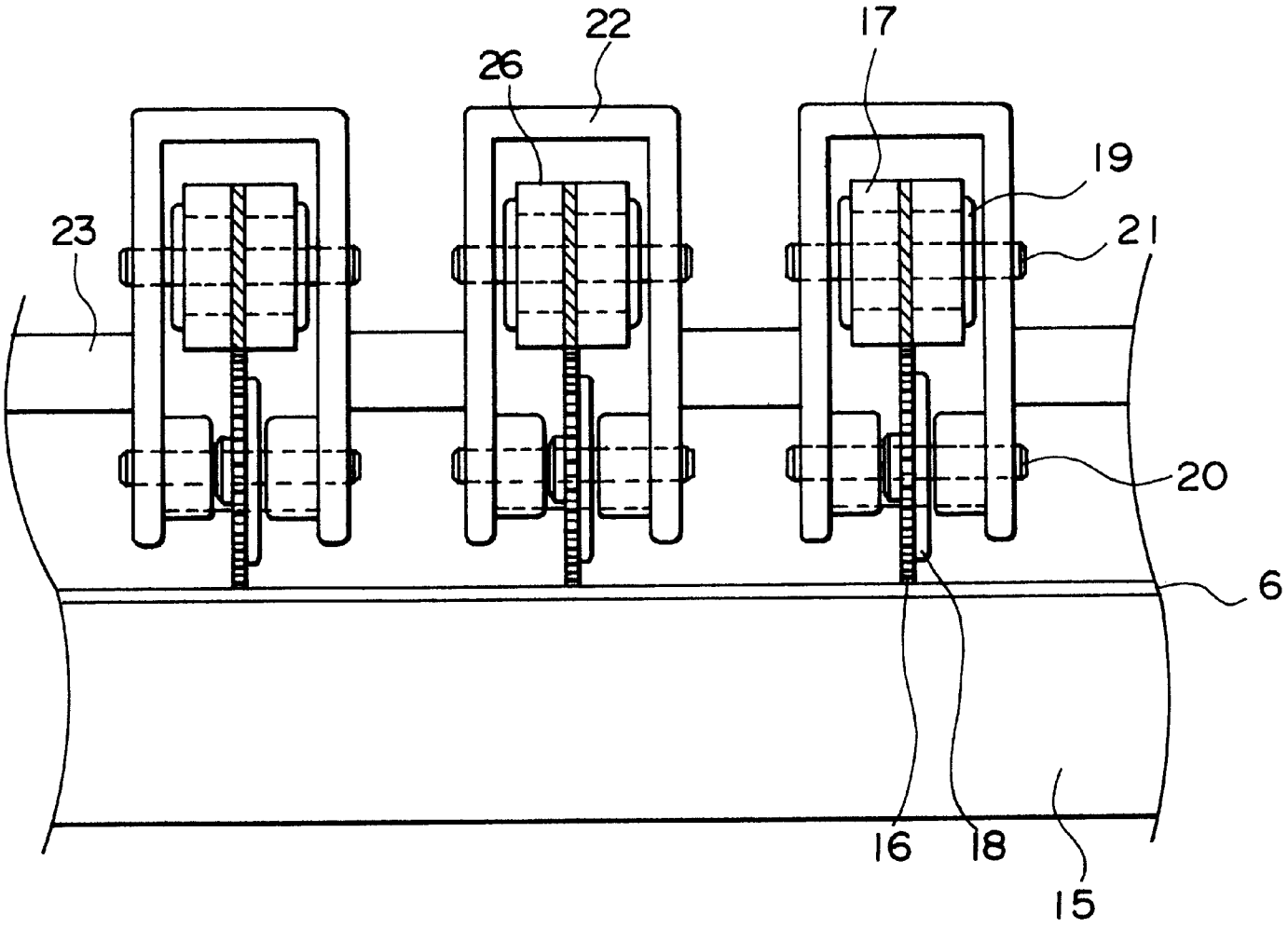

FIG. 1 is a front view of a discharge roller and therearound, according to a first embodiment of the present invention. Incidentally, the same elements as those shown in FIGS. 6 and 7 are designated by the same reference numerals. FIG. 5 is a schematic sectional view of a recording apparatus to which the present invention can be applied.

First of all, a print mechanism portion constituting a recording portion will be described. In FIG. 5, a recording head (recording means) 1 for effecting the recording by discharging ink droplets is mounted on a carriage 2 for shifting the recording head 1 for recording scan, and ink is supplied to the recording head from an ink tank 3 mounted on the carriage 2. The carriage 2 is supported by a guide shaft 4 and a guide rail 5 which are secured to side walls (not shown) of the recording apparatus so that the carriage 2 can be reciprocally shifted along these elements 4, 5. Thus, the scanning movement of the carriage is performed along the guide shaft 4 and the guide rail 5 by means of a carriage motor (not shown) through a timing belt (not shown).

A roller 2*a* rotatably mounted on the carriage 2 is rested on the guide rail 5 so that, when the roller is rolled on the guide rail, the carriage 2 is shifted. While the scanning movement of the carriage 2 is being performed, the recording head 1 is driven in response to recording data to discharge ink droplets, thereby effecting the recording.

Next, various elements of a sheet supply and feed mechanism will be explained from an upstream side in a sheet conveying direction. Recording media 6 such as sheets on which an image is to be recorded by the discharged ink droplets are stacked on a sheet supply tray 7. Above the sheet supply tray 7, there is disposed a sheet supply roller 8 for separating an upper most recording medium 6 from the stack of the recording media and for supplying the separated recording medium to a pair of feed rollers 9.

When the sheet supply roller 8 is rotated in an anti-clockwise direction, the supplied recording medium 6 reaches the pair of feed rollers 9 while being guided by sheet guides 10, 10*a* and then is pinched between the rollers 9. The pair of feed rollers 9 comprises a lower feed roller 11 rotated in a clockwise direction by means of a motor through a gear train (not shown) and an upper feed roller 12 urged against the lower feed roller 11 by a biasing means (not shown) and driven by-the rotation of the lower feed roller. A sheet hold-down plate 13 disposed at a downstream side of the pair of feed rollers 9 serves to contact the sheet with a platen 14 having a flat recording medium guiding surface for supporting the recording medium 6 in a confronting relation to the recording head 1.

With this arrangement, a recording operation is effected as follows. The uppermost recording medium 6 separated by the rotation of the sheet supply roller 8 is directed to the pair of feed rollers 9 while being guided by sheet guides 10, 10*a*, where a tip end of the recording medium is pinched between the rollers 9. Then, by the rotation of the lower feed roller 11, the recording medium 6 is conveyed along the platen-14 while being urged against the platen 14 by means of the hold-down plate 13. At a position opposed to the recording head 1, an image is formed on the recording medium 6 by the ink droplets discharged from the recording head 1.

The tip end of the recording medium 6 on which the image was formed is conveyed by spurs 16 while being urged against a discharge roller 15 in a direction shown by the arrow 24 and then discharged onto a discharge tray 25. Each spur 16 is provided at its periphery with a plurality of radial teeth 16*a* so that the spur can be contacted with the recording medium 6 with minimum contact area. The spurs are driven by the movement of the recording medium.

Next, a discharge portion will be explained.

In FIG. 1, the spurs 16 serve to urge the recording medium 6 against the discharge roller 15 for discharging the recording medium 6 from a recording portion, spur cleaners 17 are urged against peripheral surfaces of the corresponding spurs 16 and are rotated by the movement of the spurs 16. Spur guides 22 are mounted on a spur guide shaft 23 extending in parallel with the discharge roller 15 so that the spurs can be rocked toward and away from the discharge roller 15. However, the spurs are normally urged against the discharge roller 15 by a biasing means (not shown).

The spurs 16 are held by respective spur supports 18 each having a spur guide pawl 26 acting as a cam follower, and the spur supports 18 are concentrically supported by corresponding spur shafts 20 for rotational movement. Each spur shaft 20 is a cylindrical cam provided at its peripheral surface with a spiral spur guide groove (cam groove) 27. Each spur guide pawl 26 is engaged with and guide by the corresponding spur guide groove 27 formed in the spur shaft 20. On the other hand, the spur cleaners 17 are held by respective spur cleaner supports 19 which are rotatably mounted on the corresponding spur guides 22 via respective spur cleaner shafts 21.

With this arrangement, even if the ink is transferred to the teeth of the rotating spurs 16 urged against the recorded surface of the recording medium 6, as the spurs are rotated, the ink transferred to the teeth 16*a* of the spurs 16 is absorbed and removed by the spur cleaners 17.

Further, since the spur guide pawls 26 are guided by the spur guide grooves 27 formed in the spur shafts 20, the spurs 16 are reciprocally shifted along the corresponding spur cleaners 17. As a result, since a contact position between each spur 16 and the corresponding spur cleaner 17 is continuously changed in a widthwise direction of the spur cleaner 17, the service life of each spur cleaner 17 is improved. Further, since the ink is accumulated in the entire surface of each spur cleaner 17, ink absorbing ability (area efficiency) of the spur cleaner is also improved. Incidentally, if a diameter of the spur 16 is the same as a diameter of the spur cleaner 17, since the spur 16 is contacted with the same spiral track on the spur cleaner 17 as the spur is reciprocally shifted, the diameter of the spur 16 is preferably different from the diameter of the spur cleaner 17.

Incidentally, although each spur guide groove is preferably spiral, the groove must form a closed loop path for reciprocally shifting the spur.

Second Embodiment

Figure 2:
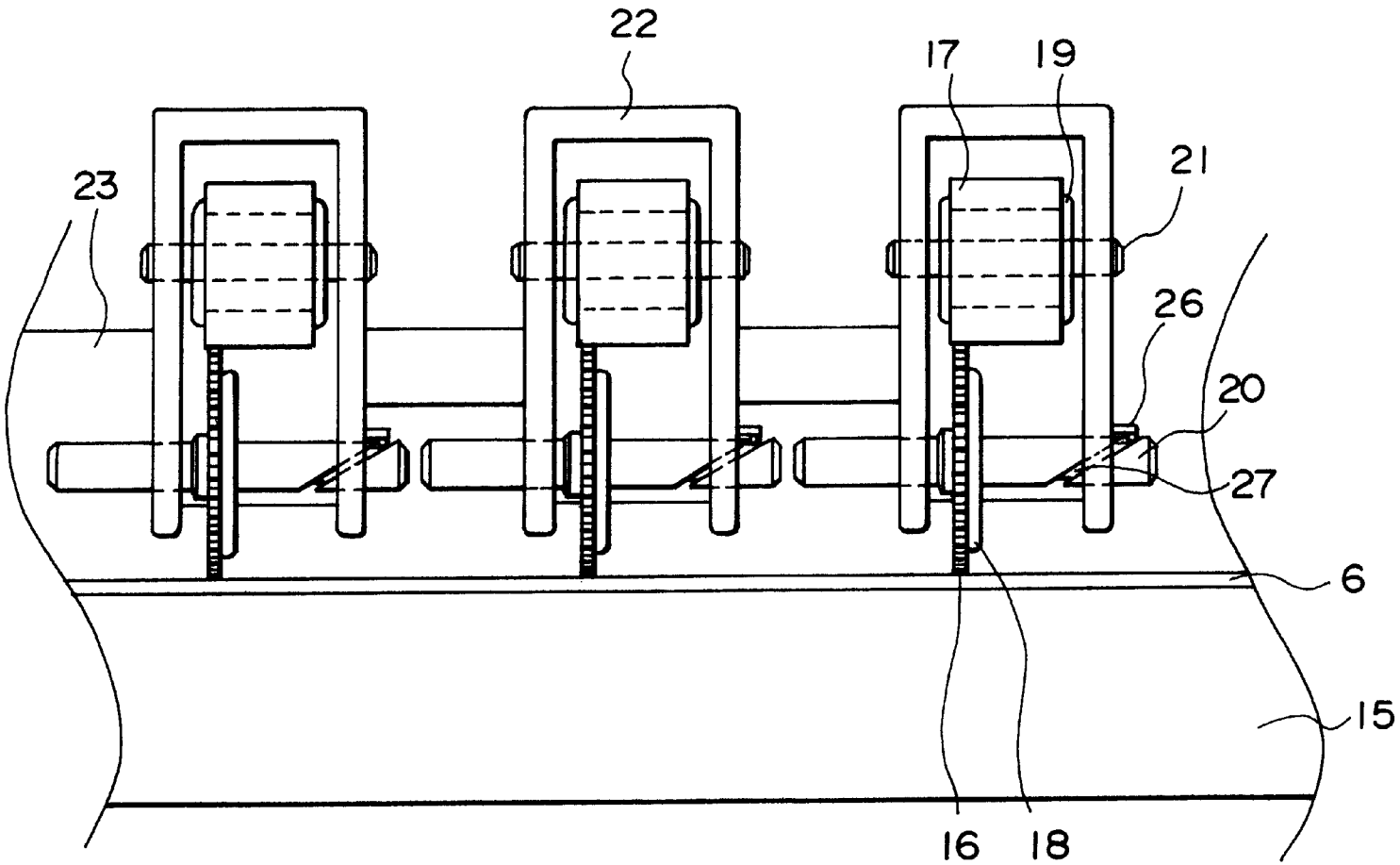
FIG. 2 is a front view of a discharge roller and therearound, according to a second embodiment of the present invention.

FIG. 2 is a front view of a discharge roller and therearound, according to a second embodiment of the present invention. Incidentally, the same elements as those in the first embodiment are designated by the same reference numerals and explanation thereof will be omitted.

In the above-mentioned first embodiment, each spur guide pawl 26 formed on the corresponding spur support 18 is guided by the single spur guide groove 27 formed in the fixed spur shaft 20. To the contrary, in the second embodiment, as shown in FIG. 2, each spur guide pawl 26 is formed on the corresponding spur guide 22, and the spur support 18 and the spur shaft 20 having the single spur guide groove 27 are formed integrally with each other so that the spur support 18 can be rotated together with the spur shaft 20 with respect to the spur guide 22.

With this arrangement, since each spur 16 is guided by the spur guide pawl 26 formed on the corresponding spur guide 22 together with the corresponding spur shaft 20 having the spur guide groove 27 to be reciprocally shifted along the corresponding spur cleaner 17, the same advantage as the first embodiment can be obtained. Incidentally, as is in the first embodiment, if a diameter of the spur 16 is the same as a diameter of the spur cleaner 17, since the spur 16 is contacted with the same spiral track on the spur cleaner 17 as the spur is reciprocally shifted, the diameter of the spur 16 is preferably different from the diameter of the spur cleaner 17.

Third Embodiment

Figure 3:
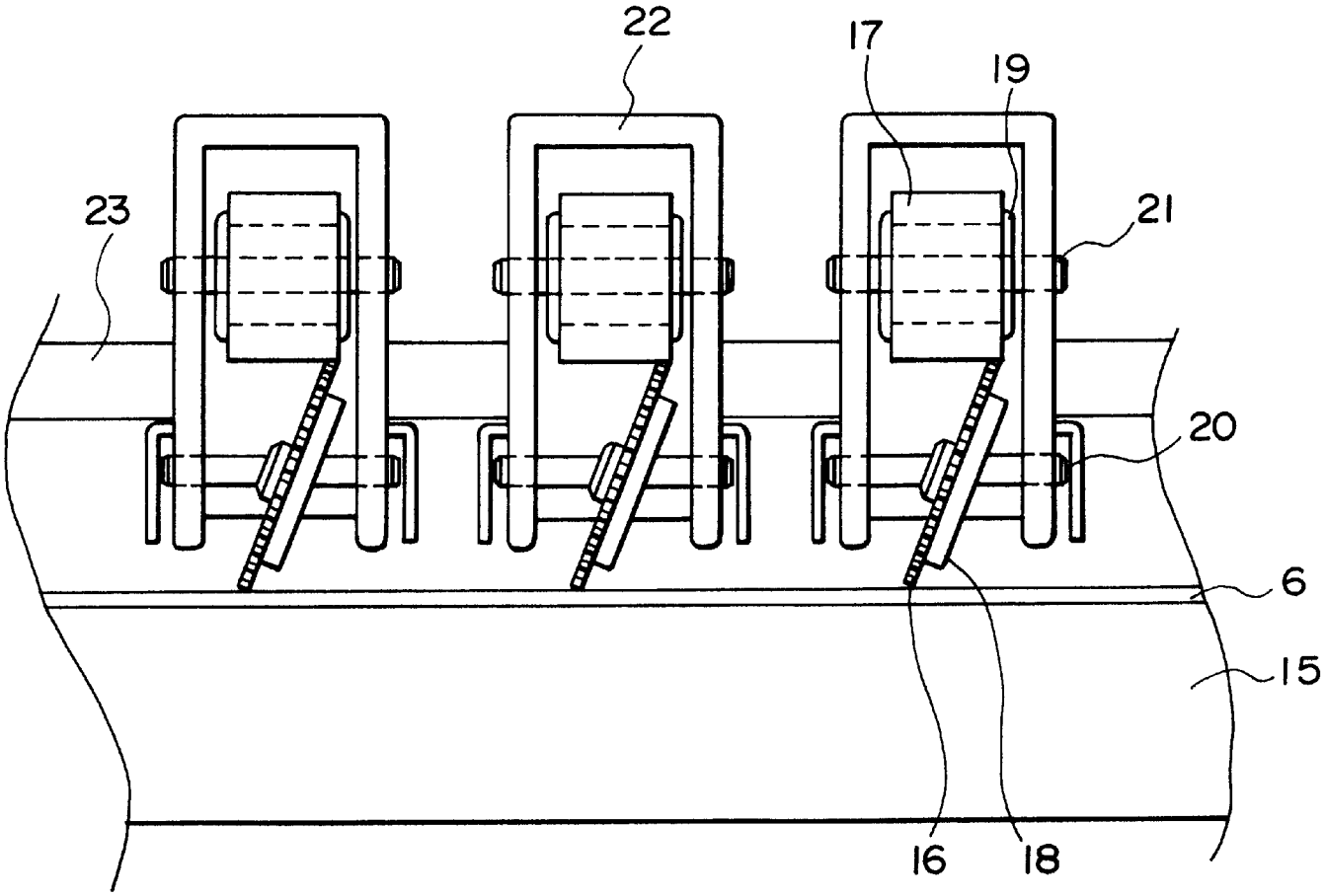
FIG. 3 is a front view of a discharge roller and therearound, according to a third embodiment of the present invention.

FIG. 3 is a front view of a discharge roller and therearound, according to a third embodiment of the present invention. Incidentally, the same elements as those in the first and second embodiments are designated by the same reference numerals and explanation thereof will be omitted.

In the third embodiment, each spur 16 abuts against the corresponding spur cleaner 17 in an inclined condition, and each spur support 18 and the corresponding spur shaft 20 so that the spur support 18 can be rotated together with the spur shaft 20 with respect to the spur guide 22. In this arrangement, although a distance between each spur shaft 20 and the recording medium 6 is continuously varied, since the corresponding spur guide 22 is always biased toward the discharge roller 15 by the biasing means (not shown), each spur 16 is continuously urged against the discharge roller 15, thereby causing no problem.

With the arrangement as mentioned above, since the spurs 16 are rotated while swinging in the widthwise direction of the spur cleaners 17, the contact position between each spur 16 and the corresponding spur cleaner 17 is continuously varied in the widthwise direction of the spur cleaner 17, thereby achieving the same advantage as the first and second embodiments. Incidentally, as is in the first and second embodiments, if a diameter of the spur 16 is the same as a diameter of the spur cleaner 17, since the spur 16 is contacted with the same spiral track on the spur cleaner 17 as the spur is reciprocally shifted, the diameter of the spur 16 is preferably different from the diameter of the spur cleaner 17.

Fourth Embodiment

Figure 4:
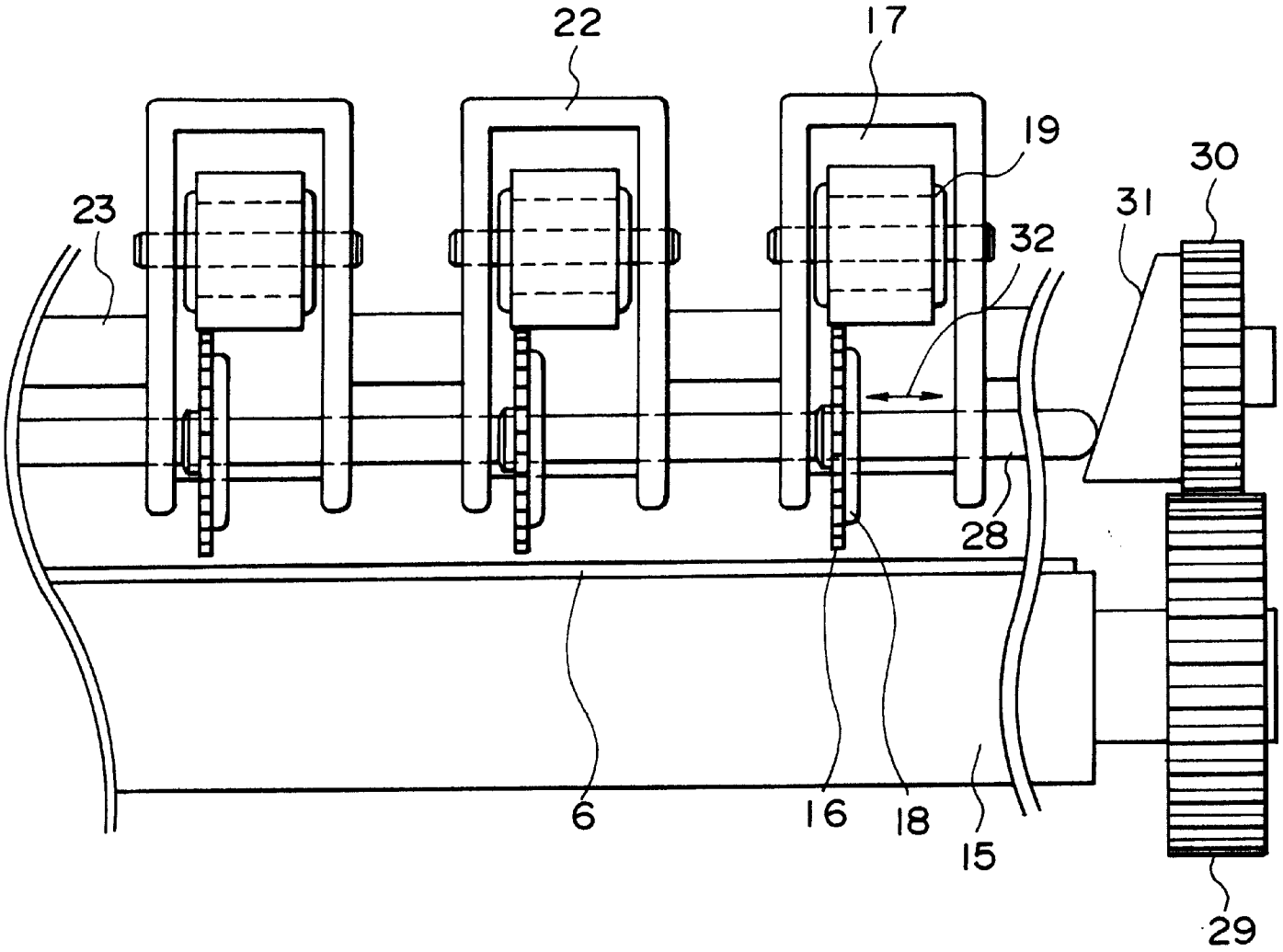
FIG. 4 is a front view of a discharge roller and therearound, according to a fourth embodiment of the present invention.

FIG. 4 is a front view of a discharge roller and therearound, according to a fourth embodiment of the present invention. Incidentally, the same elements as those in the first to third embodiments are designated by the same reference numerals and explanation thereof will be omitted.

In the fourth embodiment, a plurality of spurs 16 are secured to a single common spur shaft 28 via corresponding spur supports 18 so that the spurs 16 can be rotated together with the spur shaft 28. One end of the spur shaft 28 is urged against a cam surface 31 of a cam gear 30 driven by a gear 29 secured to the discharge roller 15. Further, the other end (not shown) of the common spur shaft 28 is always biased toward the cam surface 31 by a biasing means (not shown).

With this arrangement, the spurs 16 are rotatingly driven by the discharge roller 15 with the interposition of the recording medium 6, together with the spur supports 18 and the spur shaft 28, and the cam gear 30 is driven by the gear of the discharge roller 15. In this case, since one end of the spur shaft 28 is urged against the cam surface 31 of the cam gear 30, the spur shaft 28 is reciprocally shifted in directions shown by the double-headed arrow 32 as the cam surface 31 is rotated.

Accordingly, since the spurs 16 are rotated while shifting along the corresponding spur cleaners 17, the same advantage as the first to third embodiments can be obtained.

Incidentally, when the cam surface 31 is designed so that a rotation cycle of each spur cleaner 17 does not coincide with the reciprocating cycle of each spur 16, a diameter of each spur 16 may be equal to a diameter of each spur cleaner 17. Further, in the fourth embodiment, while an example that the spurs are reciprocally shifted by utilizing the cam surface 31 of the cam gear 30 driven by the gear 29 of the discharge roller 15 was explained, the spurs 16 may be reciprocally shifted by a discrete reciprocating mechanism.

In the above-mentioned embodiments, while an example that the contact position between each spur and the corresponding spur cleaner is varied by reciprocating or swinging the spurs was explained, the spur cleaners may be reciprocally shifted or swingingly rotated with respect to spurs which are not shifted in the widthwise direction. Alternatively, both the spurs and the spur cleaners may be reciprocally shifted.

Further, in the above-mentioned embodiments, while an example that the reciprocal movement of the spurs is automatically effected by rotating the spurs was explained, the present invention is not limited to such an example. For example, so long as the positions of the spurs or/and spur cleaners can be changed in the widthwise direction, by changing the positions of the spurs or the spur cleaners by an operator, the aimed advantage can be achieved.

The ink jet head used in the above-mentioned embodiments has ink discharging nozzles within which heat generating elements are disposed so that a bubble is formed in the ink by thermal energy generated by the heat generating element and the ink is discharged from the nozzle by the growth of the bubble. The spur cleaners used in the above-mentioned embodiments are absorbing bodies made of liquid-absorbing material such as foam urethane resin.

As mentioned above, according to the present invention, since the position between each rotary member and the corresponding spur cleaner is varied in the widthwise direction of the cleaner, the rotary member is not urged against the same area of the cleaner, thereby improving the service life of each cleaner. Further, since the ink absorbed from the rotary member is not accumulated in the same area of each cleaner but accumulated in the entire area of the cleaner, the absorbing ability, i.e., effieiency of each cleaner is also improved.

What is claimed is:

1. A recording medium convey apparatus comprising:

a disk-like rotary member rotated while contacting a recorded surface of a recording medium on which the recording has been effected using ink; and cleaner means for removing ink transferred to said disk-like rotary member from the recording surface of the recording medium by contact with said disk-like rotary member;

wherein said disk-like rotary member is inclined with respect to a shaft thereof, so that a contact position where said disk-like rotary member contacts said cleaner means is reciprocally shifted in a widthwise direction of said cleaner means.

2. A recording medium convey apparatus according to claim 1, wherein said disk-like rotary member is a spur provided at its periphery with teeth contacting the recording medium with small contact area.

3. A recording medium convey apparatus according to claim 1, wherein said cleaner means is made of ink-absorbing material.

4. A recording medium convey apparatus according to claim 1, wherein said cleaner means is supported for rotation while being contacted with said disk-like rotary member.

5. A recording medium convey apparatus according to claim 1, further comprising another rotary member cooperating with said disk-like rotary member to pinch and convey the recording medium.

6. A recording medium convey apparatus according to claim 1, wherein at least one of said disk-like rotary member and said cleaner means is reciprocally shifted in the axial direction corresponding to rotation of said disk-like rotary member.

7. A recording medium convey apparatus according to claim 6, further comprising cam means for reciprocally shifting at least one of said disk-like rotary member and said cleaner means in the axial direction corresponding to rotation of said disk-like rotary member.

8. A recording medium convey apparatus according to claim 7, wherein said cam means is a groove formed in a rotary shaft of said disk-like rotary member, or said cleaner means.

9. A recording medium convey apparatus according to claim 8, wherein at least one of said disk-like rotary member and said cleaner means is supported by said rotary shaft slidably in an axial direction, and has an integral cam follower engaged by said groove.

10. A recording medium convey apparatus according to claim 8, wherein said groove is spirally formed in a peripheral surface of said rotary shaft.

11. A recording medium convey apparatus according to claim 8, wherein said groove is inclined in an axial direction, and extending along the peripheral surface of said rotary shaft by one revolution.

12. A recording medium convey apparatus according to claim 7, wherein said cam means reciprocally shifts a disk-like shaft of said rotary member or said cleaner means in an axial direction.

13. A recording medium convey apparatus according to claim 1, wherein at least one of said rotary member and said cleaner means is swung in the axial direction corresponding to rotation thereof.

14. A recording medium convey apparatus according to claim 1, wherein a recording is effected by an ink jet recording head.

15. A recording medium convey apparatus according to claim 14, wherein said ink jet recording head effects the recording by utilizing an ink droplet generated by thermal energy.

16. A recording medium convey apparatus comprising:

a rotary member contacting with a conveying recording medium to be followingly rotated; and cleaner means contacting said rotary member for cleaning said rotary member, said cleaner means being following driven by said rotary member, wherein a contact position on said cleaner means where said rotary member contacts said cleaner is shifted as said rotary member is rotated.

17. A recording medium convey apparatus according to claim 16, Wherein disk-like said rotary member is a spur with teeth on a periphery of said spur for contacting the recording medium with a small contact area.

18. A recording medium convey apparatus according to claim 17, wherein said cleaner means is supported rotatably while being contacted with said rotary member.

19. A recording medium convey apparatus according to claim 18, further comprising a cam for reciprocally shifting at least one of said rotary member and said cleaner means in an axial direction of rotation of said rotary member.

20. A recording medium convey apparatus according to claim 19, wherein said cam means is a groove formed in a rotary shaft of said rotary member or said cleaner means.

21. A recording medium convey apparatus according to claim 20, wherein at least one of said rotary member and said cleaner means is supported by said rotary shaft slidably in an axial direction, and has an integral cam follower engaged by said groove.

* * * * *

UNITED STATES PATENT AND TRADEMARK OFFICE

CERTIFICATE OF CORRECTION

PATENT NO. : 6,062,685
DATED : May 16, 2000
INVENTOR(S) : Kazuo Ohyama et al.

It is certified that error appears in the above-identified patent and that said Letters Patent is hereby corrected as shown below:

Title page,
Item [56] References Cited, under "FOREIGN PATENT DOCUMENTS"
"1226379" should read -- 1-226379 --.

Column 3,
Line 24, "by-the" should read -- by the --.
Line 67, "guide" should read -- guided --.

Column 6,
Line 24, "effieiency" should read -- the efficiency --.
Line 34, "member;" should read -- member, --.

Column 8,
Line 3, "ing" should read -- ingly --.
Line 4, "on said cleaner means" should be deleted.
Line 9, "Wherein" should read -- wherein --.

Signed and Sealed this

Second Day of April, 2002

*Attest:*

*Attesting Officer*

JAMES E. ROGAN
*Director of the United States Patent and Trademark Office*